United States Patent [19]

Good et al.

[11] Patent Number: 5,020,761

[45] Date of Patent: Jun. 4, 1991

[54] HANG TAB FOR HANGING OBJECT ON SINGLE OR DOUBLE WIRE HANGER

[75] Inventors: David M. Good, Peachtree City, Ga.; Eugene S. Stephens, Rochester, N.Y.

[73] Assignee: Voxcom, Inc., Peacktree City, Ga.

[21] Appl. No.: 432,923

[22] Filed: Nov. 7, 1989

Related U.S. Application Data

[63] Continuation of Ser. No. 161,490, Feb. 29, 1988, abandoned.

[51] Int. Cl.[5] ..... F16L 3/08

[52] U.S. Cl. ..... 248/317; 248/225.1; 211/57.1

[58] Field of Search ..... 248/225.1, 317, 339, 248/340, 350, DIG. 6, 217.3; 211/57.1, 59.1, 54.1; 40/657, 662, 124.1; 428/43

[56] References Cited

U.S. PATENT DOCUMENTS

| | | | |
|---|---|---|---|
| 2,022,270 | 11/1935 | Bender et al. | 40/622 |
| 2,077,316 | 4/1937 | Geib | 248/321 |
| 2,333,715 | 11/1943 | Hahnemann | 211/70.1 X |
| 2,532,132 | 11/1950 | Vogel | 40/124.4 |
| 2,656,918 | 10/1953 | Holles | 248/DIG. 2 X |
| 3,088,620 | 5/1963 | Crawford | 248/300 |
| 3,410,397 | 11/1968 | Cato | 206/1.40 |
| 3,490,123 | 1/1970 | Clark | 428/43 X |
| 4,079,838 | 3/1978 | Granum | 248/DIG. 9 |
| 4,688,683 | 8/1987 | Tlakenfeld et al. | 211/57.1 |
| 4,693,441 | 9/1987 | Conway | 248/225.1 |
| 4,718,627 | 1/1988 | Fast et al. | 248/225.1 |
| 4,839,977 | 6/1989 | Krautseuek | 211/57.1 X |

FOREIGN PATENT DOCUMENTS

| | | | |
|---|---|---|---|
| 3432850 | 3/1986 | Fed. Rep. of Germany | 211/88 |
| 1348012 | 11/1963 | France | 40/662 |
| 2032512 | 5/1980 | United Kingdom | 248/317 |

*Primary Examiner*—Alvin C. Chin-Shue

*Attorney, Agent, or Firm*—Eugene Stephens & Associates

[57] ABSTRACT

The hanging region (33) of a supporting web (31) of a hang tab (30) adhered to a supported object is cut and is bendable to form an opening divided between a central region that receives a single wire hanger (20) and end regions (38) that receive a double wire hanger (24). Uncut tension zones (40) between the central region and the end regions (38) are breakable to receive double wire hanger (24), but remain unbroken to help support the weight of an object hanging on single wire hanger (20).

15 Claims, 2 Drawing Sheets

HANG TAB FOR HANGING OBJECT ON SINGLE OR DOUBLE WIRE HANGER

RELATED APPLICATIONS

This application is a continuation of parent application Ser. No. 161,490, filed Feb. 29, 1988, entitled HANG TAB FOR HANGING OBJECT ON SINGLE OR DOUBLE WIRE HANGER, and abandoned upon the filing of this continuation application.

BACKGROUND

Hang tabs are used in large numbers for hanging a wide variety of small products on the wire hangers of sales display racks. The hang tabs have an opening, usually in the form of a squat, isosceles triangle, having an apex that can receive a single wire hanger and having a base broad enough to receive a double wire hanger.

Hang tabs are generally adhered to the box or package they support, and they are usually formed to fold flat against the package they are adhered to, until the package is removed from a packing case and hung up for sales display. A popular form of such a hang tab is made of clear polyester resin that does not obscure the package the tab is adhered to. To successfully resist peel and sheer forces involved in hanging the object from the tab, the tab is made of relatively thick and expensive polyester resin that is formed with a hinge line as the tab is die cut, so that the tab can fold flat against the package it is adhered to. A relatively aggressive and expensive adhesive is also required to ensure that the hang tab is reliable in holding an object or package on a supporting wire for an indefinite length of time.

Experiments have shown that thinner and less expensive polyester resin hang tabs adhered to objects or packages with ordinary and less expensive pressure-sensitive adhesive fail to work satisfactorily when the tab is hung on a single wire hanger. Apparently, the hanging stress from the weight of the object supported by the tab, in being transmitted upward around the ends of the triangular-shaped opening to the apex of the triangle, imposes a wave or curl shape on the tab; and this exerts peel forces on the adhesive. Adhesives are not good at resisting peel forces; and after hanging for awhile, the package peels away from the tab and falls to the floor. This problem does not occur with double wire hangers, but they constitute only a small portion of the hangers being used in stores.

The invention solves this problem, however; and the solution involves changing the way the tab is cut to form the opening that receives single and double wire hangers. Although the improved opening can still accommodate both single and double wire hangers, it provides extra support for the hanging object when a single wire hanger is used. This successfully resists the peel forces that would otherwise occur and allows a thin and inexpensive hang tab, adhered to an object with ordinary pressure-sensitive adhesive, to perform reliably in hanging the object indefinitely from a single wire hanger. This significantly reduces the cost of hang tabs using an opening formed according to the invention; and since hang tabs are applied in large numbers to competitively priced commodities, any cost saving is significant.

SUMMARY OF THE INVENTION

The improved opening according to the invention has a central region for receiving a single wire hanger and end regions, on opposite sides of the central region, for receiving a double wire hanger. A cut configuration, forming the opening, separates the central region from the end regions by uncut tension zones disposed on opposite sides of the central region, between the central region and the end regions. The central region of the opening can bend from the plane of the tab to receive a single wire hanger without breaking the uncut tension zones, which help bear the weight of the object hanging from the tab on a single wire hanger. The uncut tension zones are narrow enough to be broken, however, by pressing the opening onto the end of a double wire hanger so that both the central region and the end regions bend from the plane of the tab to receive a double wire hanger. Several different cut configurations can accomplish the division of the opening into central and end regions separated by uncut tension zones.

DRAWINGS

DETAILED DESCRIPTION

Figure 1:
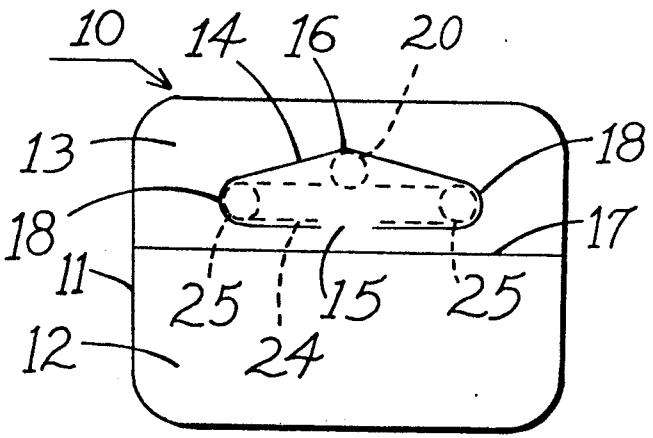
Prior art Fig. 1.
FIG. 1 is a front elevational view of a prior art form of hang tab having an opening that can receive either a single or double wire hanger.

Prior art hang tab 10, as shown in FIG. 1, is preferably formed of a clear, polyester resin supporting web 11 having an adhering region 12, where an adhesive adheres tab 10 to an object or package, and a hanging region 13, where tab 10 can be hung on single or double wire hanger, for sales display. An opening in hanging region 13 is formed within cut line 14 that extends part way around a squat, isosceles triangle. An uncut region 15, in the middle of the triangle base, allows the triangle to bend open as hanging region 13 is pressed onto a wire hanger. The apex 16 of the triangular cut line 14 centers hanging region 13 on a single wire hanger 20, and the base of the triangle is wide enough so that its end regions 18 can receive the double wires 25 of a double wire hanger 24. Since supporting web 11 has to be relatively thick to be reliable, a hinge line 17 is formed between adhering region 12 and hanging region 13 at the same time that tab 10 is die cut, so that hanging region 13 can bend along hinge line 17 to fold flat against a package to which region 12 is adhered.

The failures that occurred when a thin polyester web was substituted for thick web 11 and an ordinary pressure-sensitive adhesive was used on region 12 were found to involve the triangular shape of cut line 14. Hanging stresses transmitted around triangular end regions 18 and up to apex 16, for hanging the weight of an object on single wire hanger 20, imposed a curl or curve shape on tab 10. This exerted a peeling force on adhering region 12, beginning at upper and outer corners of region 12. Since the pressure-sensitive adhesive offered only weak resistance to peeling forces, the peeling proceeded slowly and more deeply into adhering region 12, until the hung package peeled loose from tab 10 and fell to the floor.

The solution to this problem involves a change in the way that the hanging opening is cut in hanging region 13, as shown in FIGS. 2 and 4–9. The cut configuration forming an opening in hanging region 13 divides the opening between a central region that receives a single wire hanger 20 and end regions that receive a double wire hanger 24. Uncut tension zones are formed between the single wire region and the double wire regions so that when the tab is hung on a single wire hanger 20, the uncut tension zones help support the weight of the object being hung and prevent the curling and peeling forces from occurring. This allows hang tabs with the divided opening to be made of thinner and much less expensive polyester resin material and to be adhered in place with an ordinary pressure-sensitive adhesive that is also less expensive. Hang tabs with the divided opening can be reinforced in hanging region 13, but do not need a formed hinge line 17, because they are sufficiently thin to be bendable. The combined economies of a less expensive supporting web 11 and a less expensive adhesive give hang tabs with divided openings a big competitive advantage.

Figure 2:
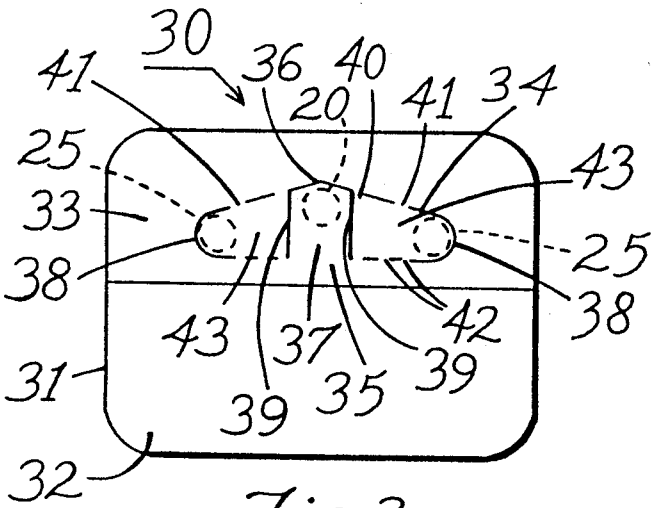
FIG. 2 is a front elevational view of a preferred embodiment of the inventive hang tab having an opening separated into a central region and a pair of end regions for respectively receiving single and double wire hangers.

Hang tab 30, as shown in FIG. 2, has such a divided opening, in the familiar triangular shape, within interrupted cut line 34. Vertical cut lines 39 extend downward from opposite sides of the triangle apex 36 so that a bendable flap 37 in a central region of the opening can bend along uncut hinge line 35 to move out of the plane of hanging region 33 to receive single wire hanger 20. This can occur while flaps 43 in end regions 38 of the triangular opening are left in the plane of hanging region 33.

Uncut tension zones are left on opposite sides of central region flap 37 and in between end regions 38 to help support the weight of an object hanging on a single wire hanger 20. These uncut tension zones include interruptions 42 in the base of cut line 34, forming a hinge line for end region flaps 43 and uncut zones 40 and 41 along the upper boundary of flaps 43. Single uncut tension zones 40 can be used in place of double uncut tension zones 40 and 41; but either way, zones 40 and 41 are narrow enough to be broken when tab 30 is pressed onto the end of a double wire hanger 24. When this occurs, end region flaps 43 are free to bend along hinge lines 42 at the base of the triangle, to open, along with central region flap 37, to receive a double wire hanger. If tab 30 is pressed onto the end of a single wire hanger, as most often occurs, uncut tension zones 40 and 41 are not broken; and only flap 37 is bent aside in the central region of the opening to receive single wire hanger 20. The unbroken and uncut tension zones 40–42 then hold supporting web 31 together between central flap 37 and end regions 38, to help support the weight of a hanging object.

Figure 3:
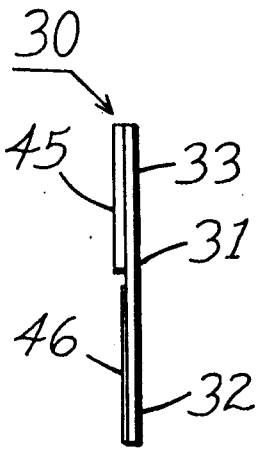
FIG. 3 is a side elevational view of the hang tab of FIG. 2.

The thin resin material that is preferred for hang tab 30 having a divided opening 34 is preferably reinforced in hanging region 33, as shown in FIG. 3. A reinforcing strip 45 can be formed of resin or paper material and can bear printed information, such as brand identification. A paper strip 45, for example, can be printed on both sides and adhered to hanging region 33 to serve both reinforcing and advertising purposes. Adhesive 46 is applied to adhering region 32, and there are many possible arrangements of reinforcing and adhesive layers. The interrupted cut line for opening 34 is formed through both supporting web 31 and reinforcing strip 45.

Many workable variations of a divided opening are shown in FIGS. 4–9. They all have an uncut tension zone 40 between a central region 37 and end regions 38, and the uncut tension zones 40 are all arranged to be unbroken when the tabs are pressed onto a single wire hanger 20 and to be broken, for opening a wider opening, when the tabs are pressed onto a hanger having double wires 25.

Figure 4:
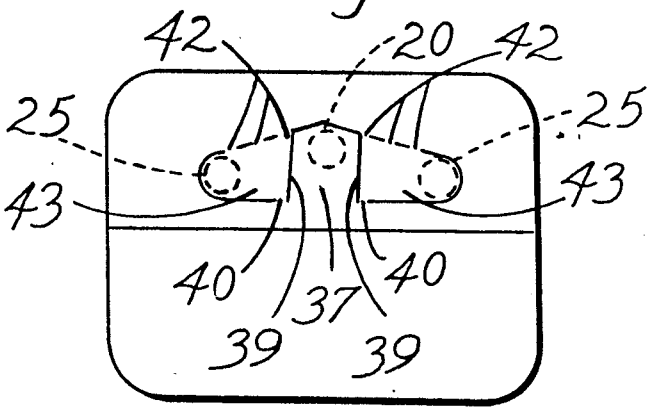

In the embodiment of FIG. 4, end region flaps 43 bend upwardly along an uncut hinge line 42, when uncut tension zones 40 are broken at the base of the opening adjacent vertical cut lines 39. Central region flap 37 bends downwardly to receive single wire hanger 20, in the same way as explained for the embodiment of FIG. 2.

Figure 5:
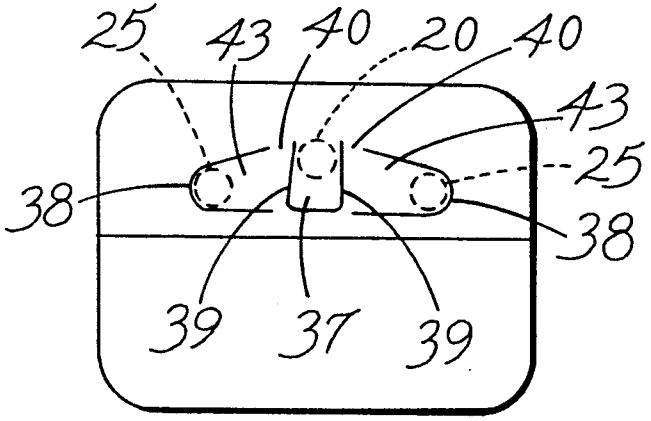
FIGS. 4–9 are front elevational views, similar to the view of FIG. 2, showing preferred alternative embodiments of the inventive hang tab.

In the embodiment of FIG. 5, central region flap 37 bends upward to receive a single wire hanger 20. End flaps 43 bend downward, in the same way as explained for the embodiment of FIG. 2; and cut lines 39 alongside central region 37 converge toward the apex of the triangle to keep single wire hanger 20 centered within the opening.

Figure 6:
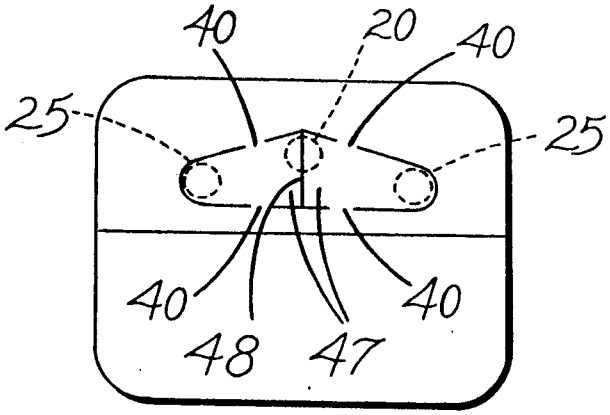

The central opening region receiving single wire hanger 20, in the embodiment of FIG. 6, is formed of a pair of flaps 47 that part like double doors along a central cut line 48. Hinge regions for flaps 47 are formed by uncut tension zones 40 that are broken when the tab is pressed onto a double wire hanger.

Figure 7:
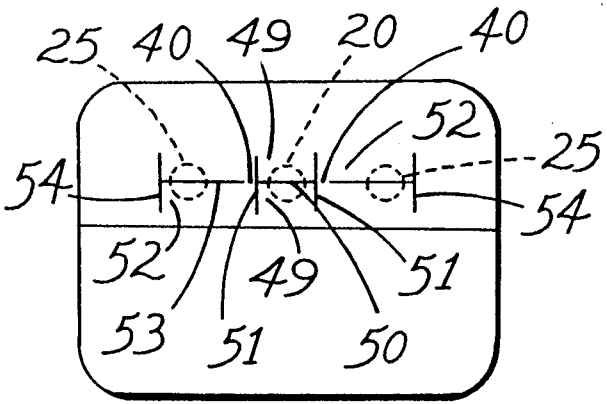

In the embodiment of FIG. 7, a pair of central region flaps 49 bend open like double doors parting at a horizontal cut line 50 extending between vertical cut lines 51. Alongside of these are uncut tension zones 40 that are broken to receive a double wire hanger. This opens end flaps 52 that part along cut lines 53 and 54 to receive double wires 25.

Figure 8:
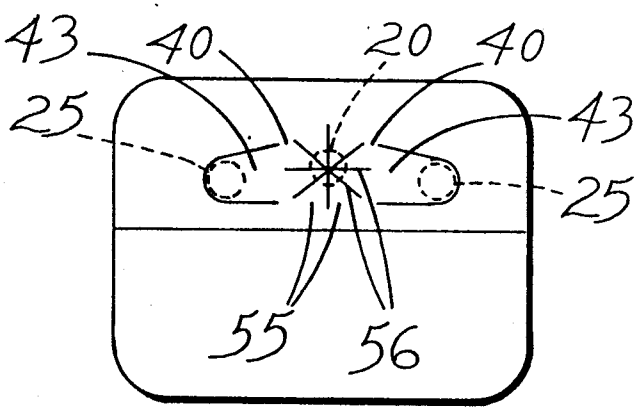

The central region of the embodiment of FIG. 8 has a plurality of flaps 55 formed by radially cut lines 56 that extend outward from a region receiving single wire hanger 20. Cut lines 56 preferably extend radially from the axis of the position where single wire 20 is received. Uncut tension zones 40 are arranged outside of central region cuts 56 and are broken to receive a double wire hanger that bends aside end region flaps 43.

Figure 9:
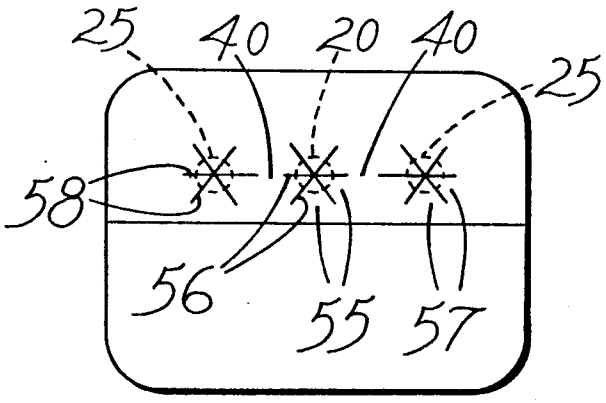

The embodiment of FIG. 9 similarly uses radial cuts 56 and multiple flaps 55 in a central region receiving a single wire hanger 20, and uncut tension zones 40 are formed beyond the ends of a horizontal cut 56. End regions receiving double hanger wires 25 are also formed to open multiple flaps 57 formed between cuts 58 extending radially from the axial positions of wires 25. When uncut tension zones 40 are broken to receive a double wire hanger, a horizontal line is opened between the central and end regions to receive the end of the hanger, and then the double wires 25 come to rest within bent aside and region flaps 57.

FIGS. 2 and 4–9 show that many variations of divided openings are possible for hang tabs according to the invention. This includes many other variations that have not been illustrated. Once the hang tab opening is divided by breakable uncut tension zones between a central region receiving a single wire hanger and end regions receiving a double wire hanger, whatever cut configuration is used allows the hang tab to take advantage of thinner and less expensive material and an ordinary and less expensive adhesive.

We claim:

1. A hanging system for suspending an object from a single wire hanger and a double wire hanger comprising:

a. a hang tab formed of sheet resin material and having a stick-on region for securing the object to said hang tab and a hanging region for suspending said hang tab from the wire hangers;

b. said hanging region being cut through in a configuration defining a central region and two end regions;

c. two uncut breakable tension zones that are located on opposite sides of said central region and in between each of said end regions, respectively, and that help support weight of the object when suspended from the single wire hanger;

d. said central region being further defined by through cuts that permit a portion of the sheet resin material to be bent in the shape of a flap forming an opening within said central region for suspending said hang tab on the single wire hanger;

e. said tension zones being spaced apart through a distance that permits the single wire hanger to pass through said opening in the central region without breaking said tension zones;

f. said end regions being further defined by through cuts which permit further portions of the sheet resin material to be bent in the shape of flaps forming within said end regions respective openings that cooperate with said opening within said central region for suspending said hang tab on the double wire hanger; and g. said tension zones also being spaced apart through a distance which permits the double wire hanger to pass through said openings in the central and end regions by breaking said tension zones.

2. The hanging system of claim 1 wherein said opening within said central region is formed by a plurality of said flaps of the sheet resin material.

3. The hanging system of claim 1 wherein each of said openings in said end regions are formed by a plurality of said flaps of the sheet resin material.

4. The hanging system of claim 1 including more than one of said tension zones located on side of said central region.

5. The hanging system of claim 1 wherein the cut configuration includes cut lines extending vertically on opposite sides of said central region and in between said tension zones.

6. The hanging system of claim 1 wherein the cut configuration includes an interrupted cut line extending around said central and end regions.

7. In a hang tab of the type formed from a web of resin material having an adhering region, where an adhesive is used to support an object from the tab, and a hanging region, where the tab can be hung from single and double wire hangers; said hanging region includes a cut line that extends part way around a squat, isosceles triangle; an apex of said triangle is centered in said hanging region for receiving the single wire hanger, and a base of said triangle is dimensioned in said hanging region for receiving the double wire hanger; and an interruption in said cut line allows said web material within said triangle to bend out of a plane of said hanging region for pressing the tab onto the wire hangers; the improvement wherein:

a configuration of cuts divides said triangle portion of said hanging region into a central region that receives the signal wire hanger, into end regions that, together with said central region, receive the double wire hanger, and into uncut tension zones respectively located on opposite sides of said central region and in between said end region to help support the weight of the object hung from the single wire hanger;

said configuration of cuts includes: (a) vertical cut lines that extend downward from opposite sides of said apex defining said central region between them, (b) a first interruption in said cut line that forms a hinge about which said central region is bendable out of said plane of the hanging region, (c) second and third interruptions in said cut line that form respective hinges about which said end regions are bendable out of said plane of the hanging region, and (d) fourth and fifth interruptions in said cut line that form, together with said second and third interruptions, said uncut tension zones;

said web material of the central region is bendable out of said plane of the hanging region to receive the single wire hanger, independently of a remaining portion of said web material within said triangle including said uncut tension zones and said end regions; and said fourth and fifth interruptions in the cut line are breakable by manual force used to press the tab onto the double wire hanger, allowing said web material of both the central and end regions to bend out of said plane of the hanging region to receive the double wire hanger.

8. The hang tab of claim 7 wherein said first interruption of the cut line is located along said base of the triangle.

9. The hang tab of claim 8 wherein said second and third interruptions of the cut lien are also located along said base of the triangle.

10. The hang tab of claim 9 wherein four additional interruptions in the cut line are used to form two additional tension zones that are located in said end regions.

11. In a hanging system for suspending an object from single and double wire hangers of the type including a hang tab made from a sheet of resin material having a stick-on region for securing to the object and a hanging region extending above the object to suspend the object from the hangers; said hanging region is cut through in a configuration that allows a portion of the sheet material to bend out of a plane of the hanging region to form an opening within said hanging region for receiving either of the hangers; and said opening is further defined by a central region having an upper edge for resting on the single wire hanger to support the weight of the object by tension resistance of said hanging region between said upper edge of the opening and said stick-on region of the tab, and by two end regions located on either side of said central region having upper side edges for resting on the double wire hanger to support the weight of the object by tension resistance of said hanging region between said upper side edges of the opening and said stick-on region of the tab; the improvement wherein:

said end regions of the opening are separated from said central region of the opening by two cut lines that allow a first portion of said sheet material to bend out of said plane of the hanging region within said central region of the opening to receive the single wire hanger, without binding second and third portions of the sheet material out of said plane of the hanging region within said end regions of the opening;

uncut tension zones are left on opposite sides of said central region of the opening so that fourth and fifth portions of the sheet material remain in said plane of the hanging region providing a pair of tension resistant paths through said opening between said end regions of the opening to help support weight of the object suspended from the single wire hanger between said upper side edges of the opening and said stick-on region of the tab; and said uncut tension zones are made narrow enough to be broken by manual pressure pushing the hang tab onto the double wire hanger, allowing all five of said portions of the sheet material within said opening to bend out of said plane of the hanging region to receive the double wire hanger with said upper side edges of the opening resting on the double wire hanger.

12. The hanging system of claim 11 in which said uncut tension zones are formed by interruptions in said cut through configuration that defines said opening.

13. The hanging system of claim 12 in which said two cut lines extend substantially vertically between opposite edges of said opening.

14. The hanging system of claim 13 in which said uncut tension zones are located adjacent to said two cut lines.

15. The hanging system of claim 14 in which said first portion of the sheet material is bendable about said upper edge of the central region of the opening.

* * * * *